United States Patent [19]

Prochaska

[11] 3,956,914

[45] May 18, 1976

[54] SPIN LATHE

[75] Inventor: Joseph Prochaska, Menominee, Mich.

[73] Assignee: The Marison Company, South Elgin, Ill.

[22] Filed: Nov. 14, 1974

[21] Appl. No.: 523,717

[52] U.S. Cl. ..... 72/80; 82/12; 228/60; 72/82

[51] Int. Cl.[2] ..... B21D 22/14

[58] Field of Search ..... 72/80, 67, 83, 84, 85; 228/60; 29/475, 515; 82/12

[56] References Cited

UNITED STATES PATENTS

| | | | |
|---|---|---|---|
| 2,351,020 | 6/1944 | Dewey | 228/60 X |
| 2,406,059 | 8/1946 | Burch | 228/60 X |
| 2,663,206 | 12/1953 | Whiting et al. | 228/60 X |
| 2,902,963 | 9/1959 | Roberts | 72/83 |
| 2,975,743 | 3/1961 | Hoffmann et al. | 72/83 X |
| 3,299,680 | 1/1967 | Thompson | 72/82 X |
| 3,653,240 | 4/1972 | Huthsing, Jr. | 72/82 |
| 3,696,695 | 10/1972 | Adams | 82/12 |

*Primary Examiner*—Milton S. Mehr
*Attorney, Agent, or Firm*—Elmer L. Zwickel

[57] ABSTRACT

A spin lathe embodying novel means to deliver pressurized fluid to means controlling operation of the work holding chuck, and a manually adjustable hydraulically actuated switch element for limiting travel of the work piece forging tool for "necking" operations. Also embodied in the structure is a novel turntable mounting for the forging tool and the method and means to blow out the hole in the partially closed end of the work piece prior to final closing of said end.

16 Claims, 13 Drawing Figures

SPIN LATHE

The invention relates to improvements in spin lathes and particularly to a spin lathe adapted to forge a metal cylindrical tube into a closed vessel for gases and liquids under pressure. More specifically, the spin lathe is characterized by the inclusion of a novel rotary element for the delivery of hydraulic fluids under pressure to a rotating body thereby allowing greater flow and precision control of the opening and closing of a collet carried by a spindle and used in holding the tubular work piece to be forged in the spindle. Also involved in the lathe is a novel tool holding turntable assembly including novel means to slide the turntable toward and away from the work piece, and hydraulically actuated means to limit turntable travel for folding and necking the work piece. The entire vessel forming operation is controlled by novel operator controlled hydraulic and electrical means insuring low cost operation and accuracy in the fold-in and necking operations; and greater accuracy and uniformity in the work with a resulting better and stronger vessel with fewer rejects and less operator fatigue. The lathe further includes novel means to clean out the axial opening present in the partially forged end of the tube prior to final closing.

It is therefore an object of the invention to provide a spin lathe of the character referred to.

Another object is to provide a novel turntable mount and means to control turntable operation.

Another object is to provide novel means to control the flow of hydraulic fluid to limit "necking" of a forged article.

Another object is to provide novel means to allow definite measured feed in a spin tool to thereby control the amount of metal spun during any pass of the spin tool.

Another object is to provide novel means to hold an article to be spun and to control such holding means.

Another object is to provide a novel rotary hydraulic element to control the flow of pressurized fluid to collet actuating means.

Another object is to provide a novel air motor driven tool slide.

Another object is to provide a novel hydraulic drive and braking unit.

Another object is to provide novel means to clean the hole in a partially forged end of a work piece prior to final closing.

Another object is to provide a spin lathe that is not expensive or difficult to manufacture, service or operate, and one that is very efficient in use.

Other objects and advantages of the invention will become apparent with reference to the following description and accompanying drawings.

IN THE DRAWINGS

Figure 1:
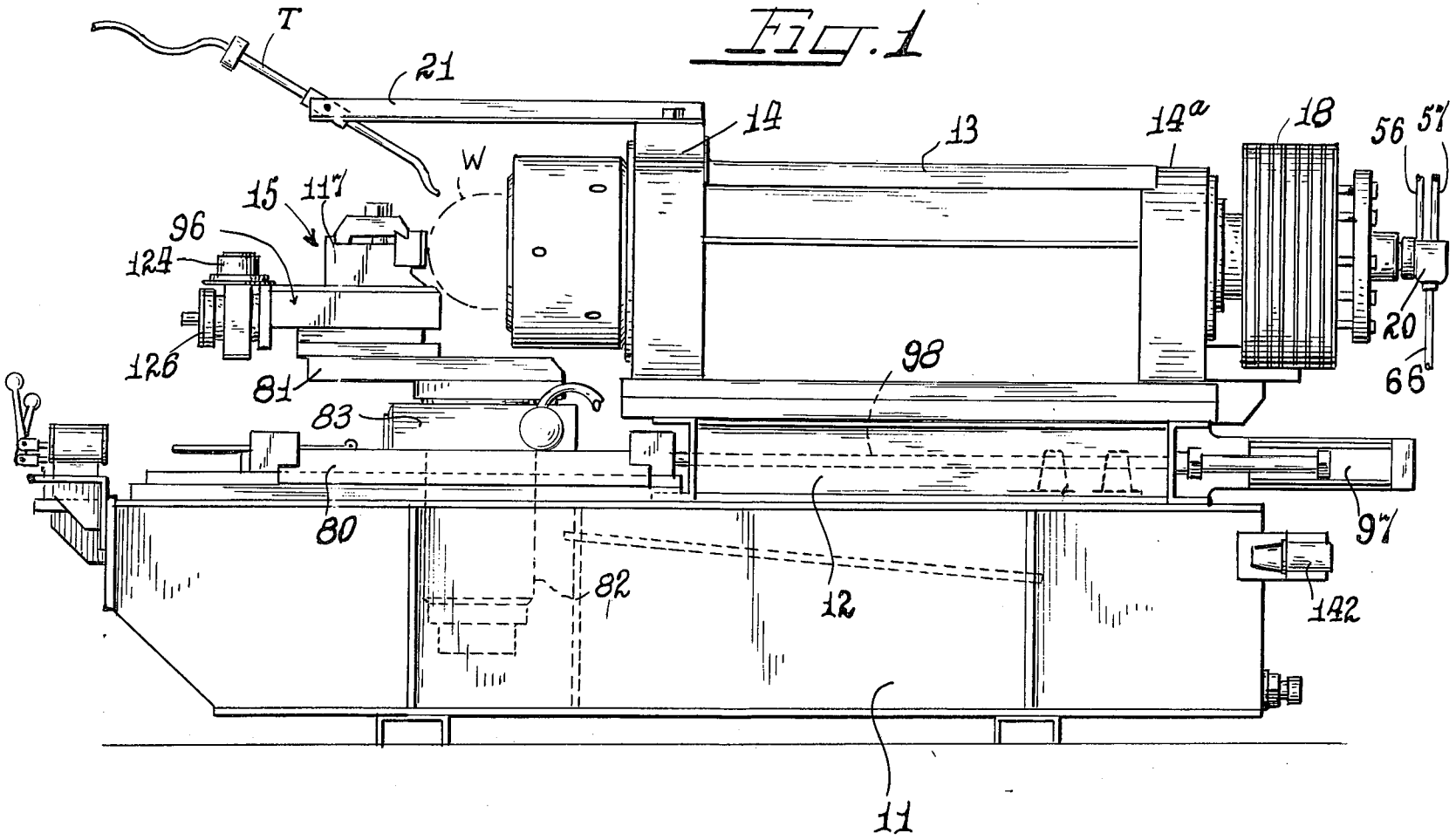
FIG. 1 is a side elevational view of the spin lathe embodying the features of the present invention.
Figure 2:
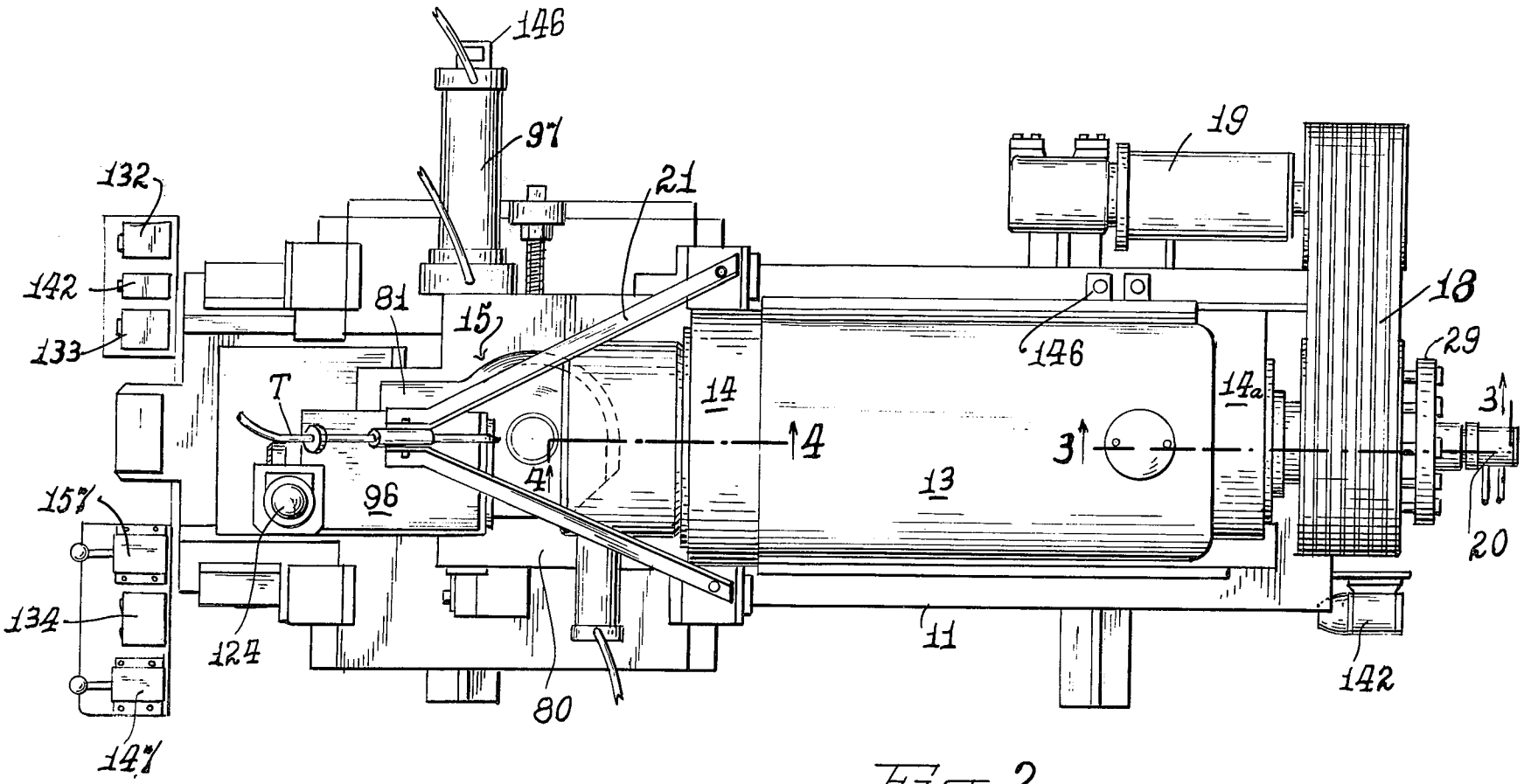
FIG. 2 is a top plan view of said lathe.

Referring to the exemplary disclosure of the invention shown in the accompanying drawings, and particularly to the assembly shown in FIGS. 1 and 2, the spin lathe is mounted on an elongated base frame 11, including a support bed 12 on which a horizontally disposed protective covering 13 including bearing journals 14, 14a is mounted. The covering 13 terminates short of one end of the base frame 11, which end mounts a turntable assembly generally indicated at 15.

Figure 3:
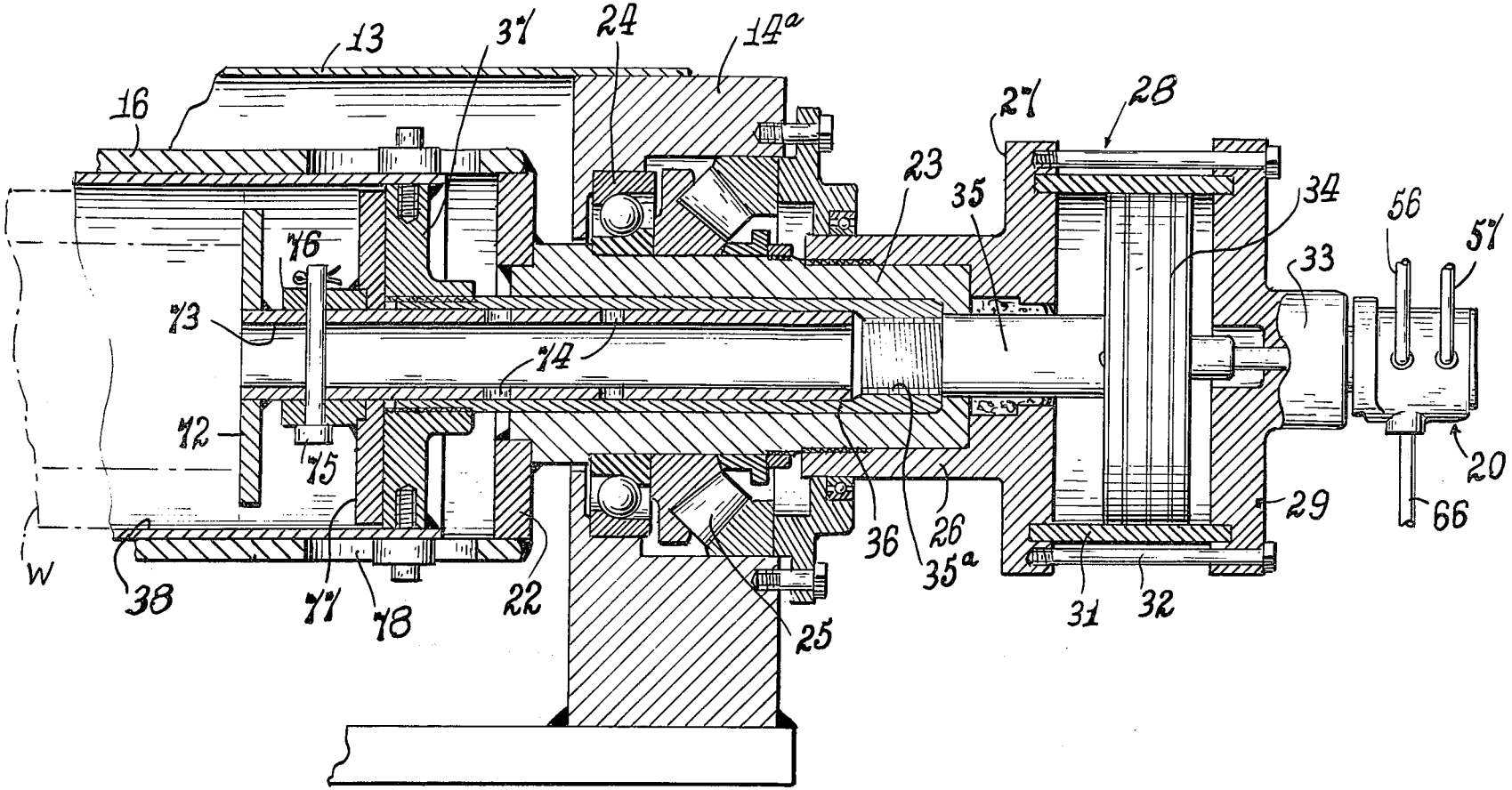
FIG. 3 is an axial sectional view of one end of the spin lathe taken substantially on line 3—3 of FIG. 2.
Figure 11:
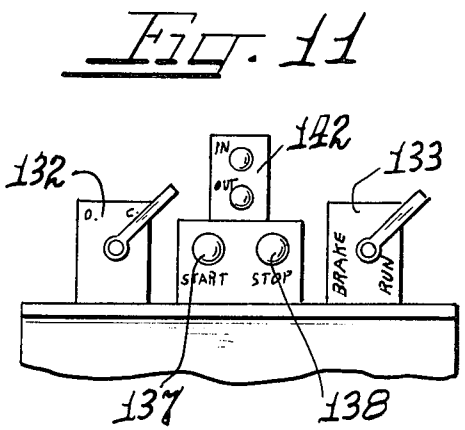
FIG. 11 is an elevational view of the spindle and collet valve control.
Figure 12:
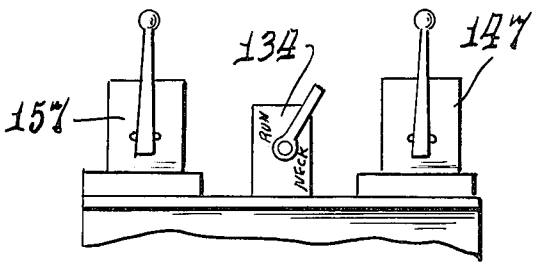
FIG. 12 is an elevational view of the tool holder controls.

Journalled on a horizontal axis within the covering 13 is a spindle 16 (FIGS. 3 and 4) having a work-holding collet 17 at its forward end disposed toward the turntable assembly. The foregoing and what follows immediately will be described in detail hereinafter and it is sufficient to note at this time that the spindle 16 is driven by means of a belt drive 18, or other means, having connection with a drive motor 19 (FIG. 2) and having, as an extension of the spindle, a rotary flow element 20 operable to deliver hydraulic fluid under pressure for opening and closing the collet when work is to be inserted or removed therein.

Figure 10:
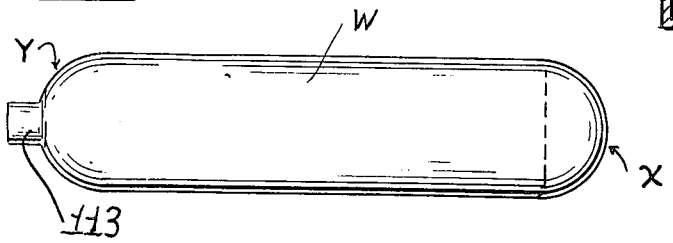
FIG. 10 is a view of a representative vessel formed in the spin lathe.

Generally, in operation, the collet is opened and a hot metal tube "W" is thrust into the spindle a measured distance with one end projecting therefrom. The collet is then closed and the spindle is rotated at high speed and, upon manipulation of novel controls, the turntable carrying a forming tool is repeatedly swept across the projecting hot end of the tube to cause said end to be forged in a manner to close the tube end. However, before final closing of the tube end, a, blast of pure oxygen at a pressure of about 55 pounds is directed at the center of the closed end by means of a torch "T", carried on a bracket 21, so as to blow out contaminants in the hole. Following this, the end is closed and tightly sealed. With this accomplished, the collet is opened and the tube withdrawn whereupon the tube is placed in a press (not shown) and the rounded forged end is flattened. Subsequently, its other end is heated and the tube is reinserted in the spindle and the collet closed to grip same whereupon the turntable is again operated in a manner to cause its tool to forge the hot end of the tube in a manner to produce a neck on the tube. The finished tube or vessel is shown in FIG. 10.

Returning now to the details of the structure, the spindle 16 is mounted (FIG. 4) at its collet or forward end in journal 14. The other end of said spindle, best shown in FIG. 3, has an integral axially apertured end wall 22 and an integral tubular bearing 23 extending rearwardly therefrom that is journalled in journal 14a. Suitable anti-friction and thrust bearings 24, 25 respectively, are provided to insure free rotation of the spindle. The rearmost end of said bearing 23 mounts a collar 26 having an external flange 27 that constitutes one end wall of a cylindrical housing 28, the other end wall of which comprises a plate 29. A housing wall 31 is arranged between end walls 27, 29 and the assembly is securely joined by tie-bolts 32. The end wall 29 has an external axial boss 33 provided for a purpose to be described presently.

Figure 4:
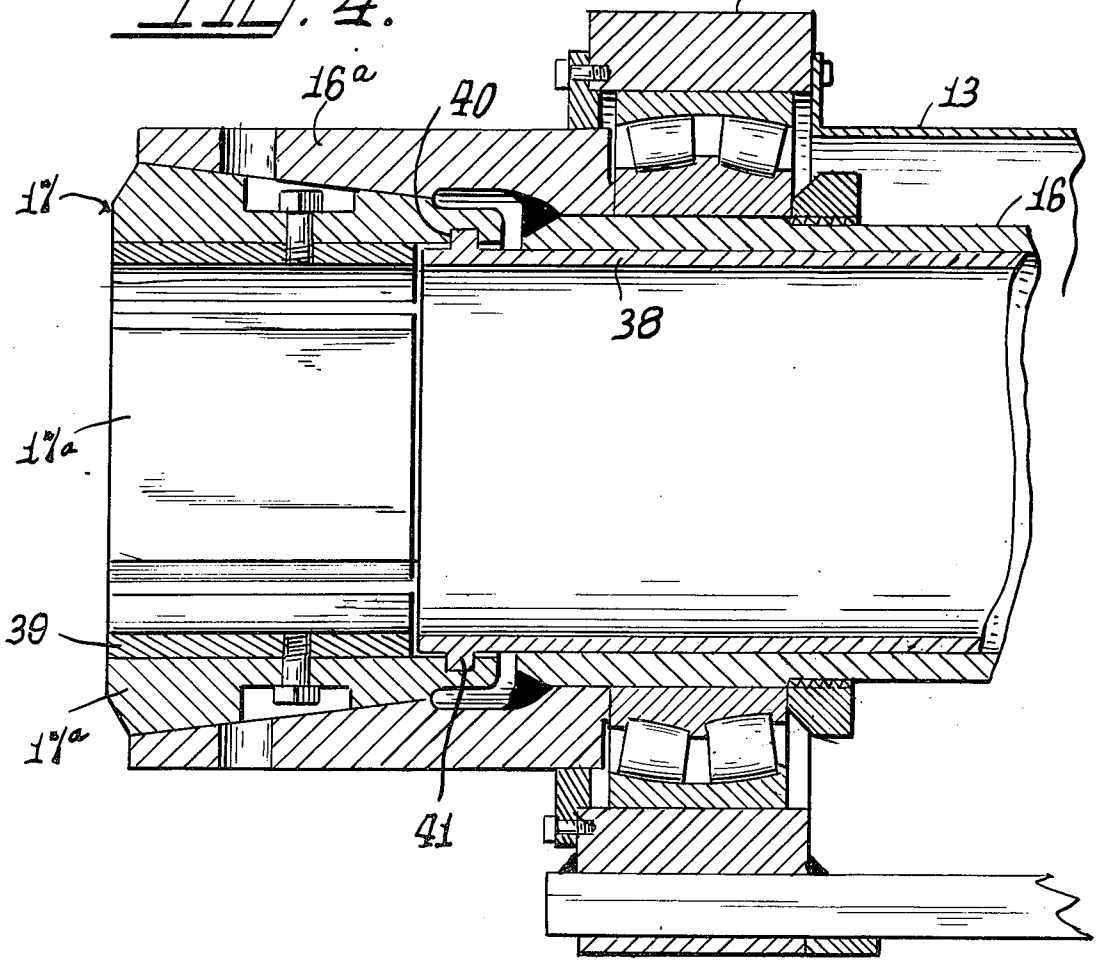
FIG. 4 is an axial sectional view of the collet end of the spin lathe taken substantially on line 4—4 of FIG. 2.

Mounted for free reciprocation with housing 28 is a piston 34 having a stud shaft 35 extending into tubular bearing 23. Its free end is threaded, as at 35*a*, to receive firmly thereon one end of a tubular extension 36, the other end of which projects into spindle 16 and mounts firmly a circular disk 37 integrally connected at its perimeter, as by welding, to one end of a collet sleeve 38. This sleeve is substantially co-extensive with the spindle 16 and terminates just beyond the related forward end of said spindle. As best shown in FIG. 4, the said end of spindle 16 carries firmly thereon a collar 16*a* formed with a tapered inside diameter within which externally tapered collet jaws 17a are circumferentially arranged. The jaws 17*a* each carry a wear or sizing plate 39 and each is formed at its inner end with a recess 40 that is seated over an external flange 41 on the related end of sleeve 38, so as to afford a mechanical connection between the sleeve and jaws. When the sleeve 38 is shifted axially by operation of piston 34, the jaws are carried therewith into open or closed positions.

The flow of hydraulic fluid under pressure into and out of each end of housing 28, for advancing and retarding sleeve 38, is controlled by means of the rotary hydraulic element 20 (FIG. 5) attached, in a manner to be described presently, to the external axial boss 33 on housing 28. The element 20 includes a stationary substantially cylindrical body 42 having an axial bore 43 therethrough in which is rotatably mounted a core 44 having an axial bore 45 extending from its forward or free externally threaded projecting end 46 to short of the other end. The threaded end 46 of said core is threadingly secured to the boss 33 as shown. An oil seal 47 prevents oil leakage at the forward end. A thrust plate 48 is secured by bolts 49 to the closed end of core 44 with its peripheral margin seated against a shoulder 50 provided in body 42 by a circumferential recess 51 in the related body end. The recess is closed and sealed by a cap plate 52 bolted to the body end.

An oil tube 53 is press fitted into bore 45 and is held against possible displacement axially by a split retaining ring 54. As shown, the oil tube 53 has a reduced external diameter for a greater part of its length to provide an annular oil flow passage 55 between it and bore 45.

The element body 42 has a pair of oil flow inlet lines 56, 57 connected therewith. Line 56 opens into an internal circumferential channel 58 on the surface of bore 45 and, communicating therewith, are a plurality of radial flow ports 59 connecting it with the annular flow passage 55. This passage 55 is in communication at all times with a set of radial oil flow ports 61 adjacent to the projecting end of core 44.

The other oil flow inlet line 57 is in flow communication with an internal circumferential channel 62. The core 44 has radial ports 63 in communication at all times with channel 62, which ports open into the interior of oil tube 53. The use of the oil tube 53 permits a larger volume of fluid to pass through the ports of given size thus allowing faster and more efficient reciprocation of collet sleeve 38.

Should there be any leakage of oil between body 42 and core 44, it will drain into passages 64–65 for discharge through a drain line 66.

Figure 5:
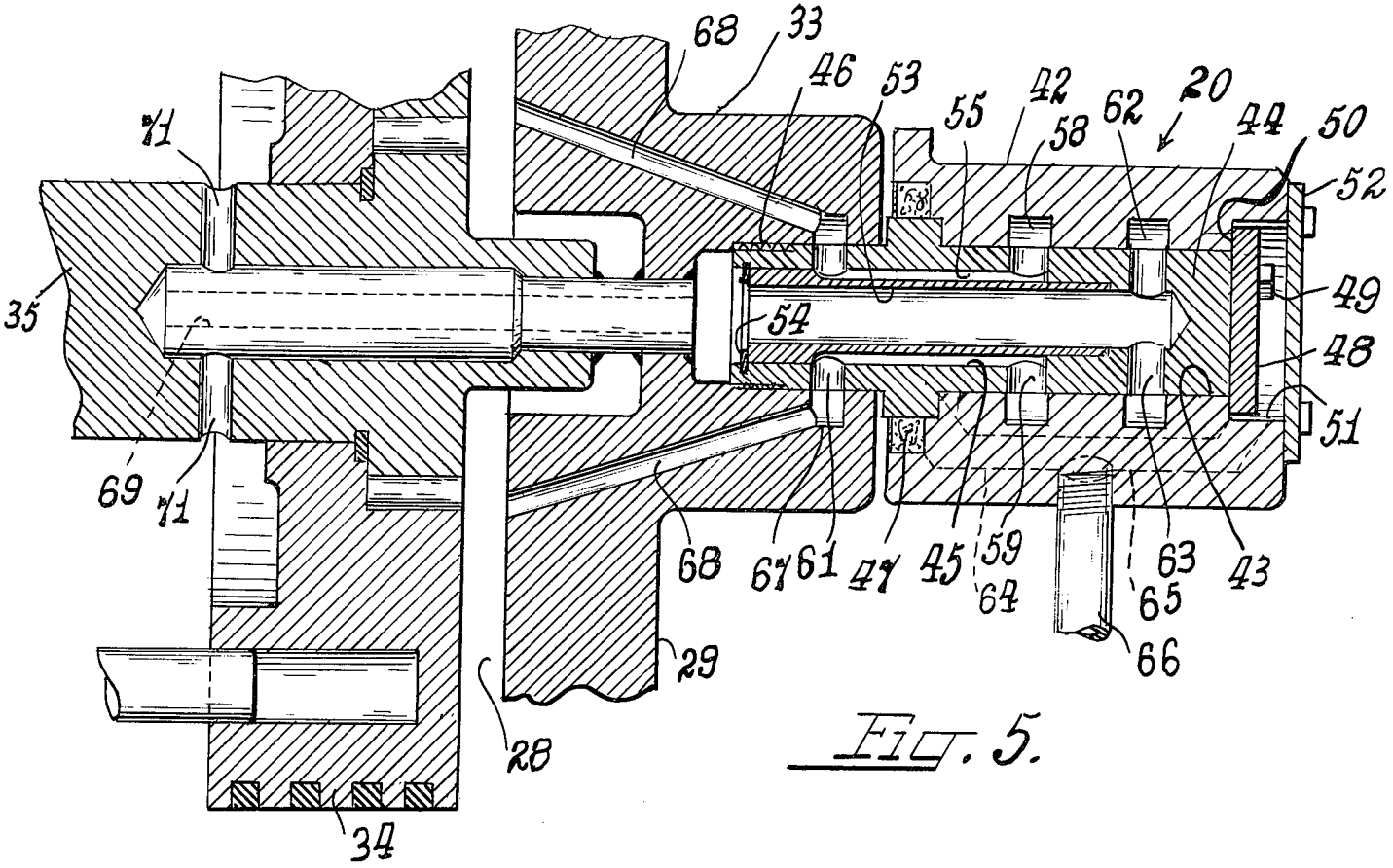
FIG. 5 is an enlarged axial sectional view of the rotary element and related parts.

Still referring to FIG. 5, the radial ports 61 in core 44 are in communication with an internal channel 67 in boss 33 which has angularly directed passageways 68 leading therefrom and opening into the piston chamber 28 on the rear side of piston 34. Thus it is apparent that when pressurized fluid is delivered through line 56, ports 59, passageway 55 to ports 61, channel 67 and passageways 68, pressure is applied to the rear surface of the piston so as to advance collet sleeve 38 and cause the collet jaws 17a to open.

When pressurized fluid is delivered through conduit 57 the fluid flows through the interior of tube 53 into an axial passageway 69, passing through piston 34, and out of radial ports 71 (FIG. 5) into chamber 28 on the forward face of said piston so as to urge the piston and its connected sleeve 38 (FIG. 3) rearwardly to close the collet jaws 17a. Accordingly, the collet jaws are selectively opened and closed to release or clamp the tubular work piece "W" thrust thereinto.

The distance to which work piece W can be inserted into the collet and spindle is determined by the setting of a stop-plate 72 (FIG. 3) secured firmly on the end of a hollow rod 73 that is telescoped loosely into tubular extension 36. The hollow rod has a series of longitudinally spaced aperatures 74 for the purpose of selectively receiving a retaining pin 75 that is passed through a collar 76 secured to a plate 77 located within sleeve 38 and which will abut the circular disk 37 when the disk is in its forward jaw clamping position. Access to pin 75 for stop-plate adjustment can be gained through access openings 78 in spindle 16.

Figures 6, 7, 8:
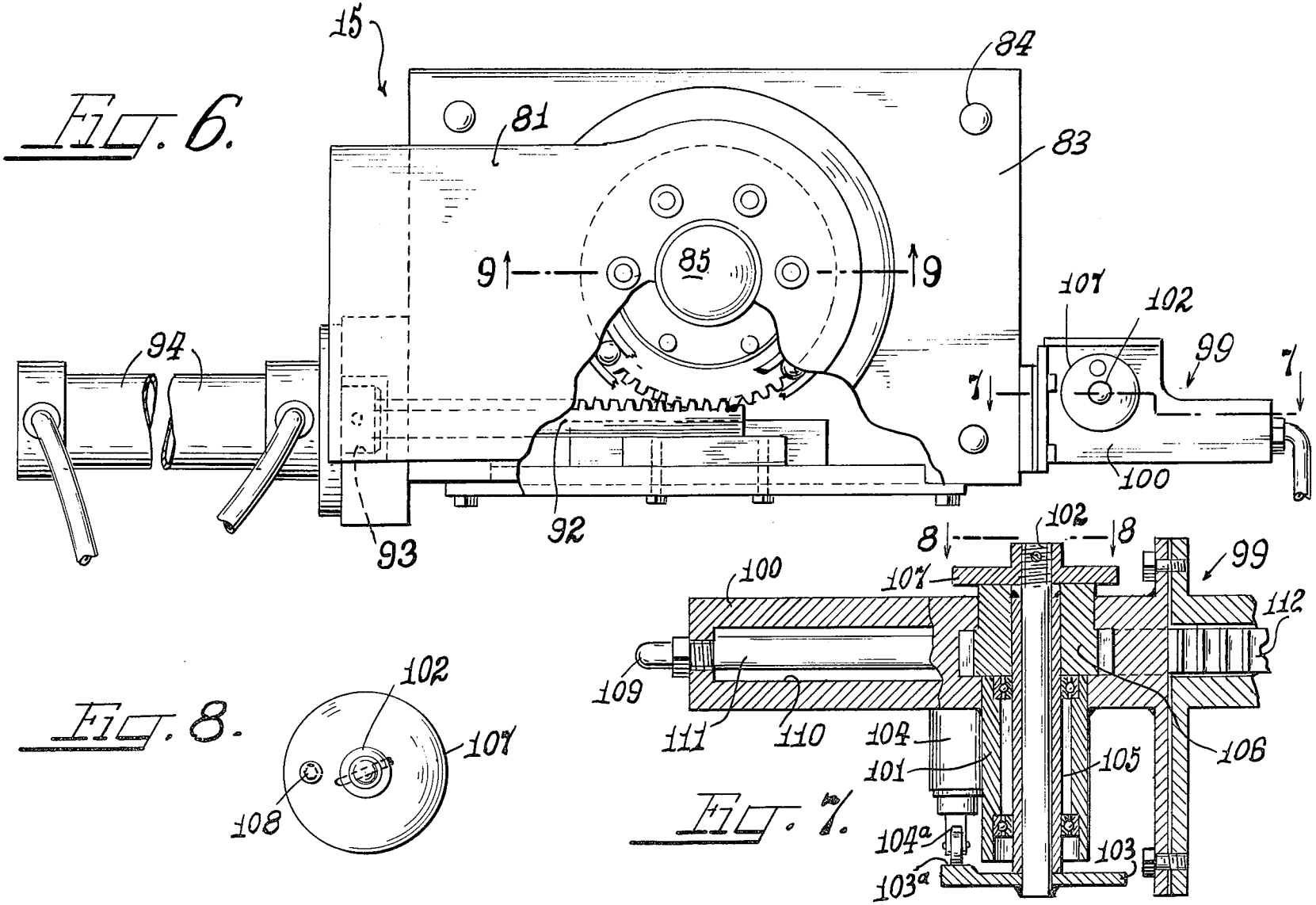
FIG. 6 is an enlarged plan view of the tool holder turntable.
FIG. 7 is a vertical sectional view of the cam switch control taken substantially on line 7—7 of FIG. 6.
FIG. 8 is a detail plan view of the switch cam adjustplate, taken on line 8—8 of FIG. 7.
Figure 9:
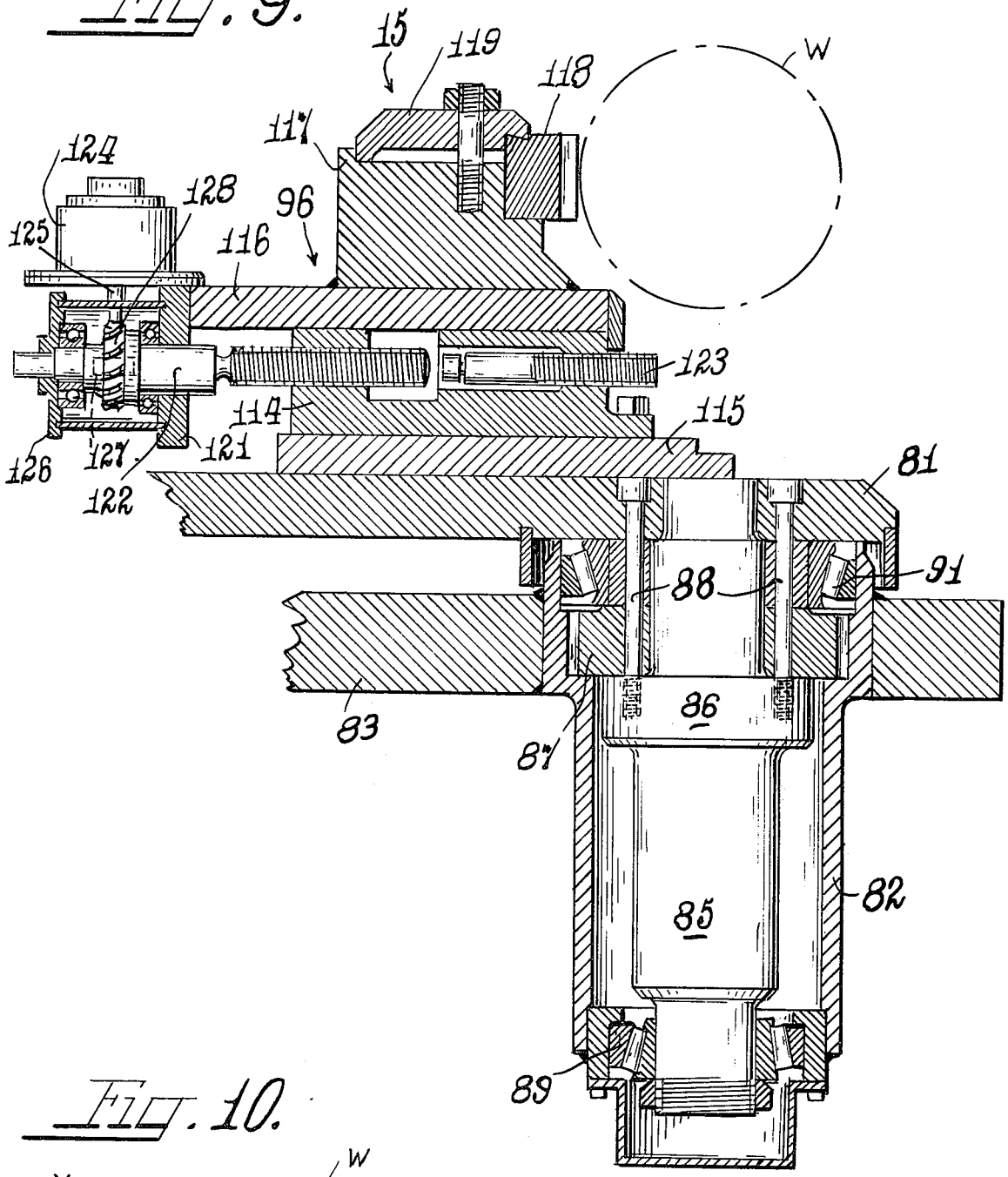
FIG. 9 is a vertical sectional view of the turntable, taken substantially on line 9—9 of FIG. 6, showing the tool holder in place thereon.

A turntable assembly 15, best shown in FIGS. 6 and 9 includes a tool holder plate 81 mounted for oscillatable rotation about a vertical axis in a hollow boss 82 depending from the base plate 83 which is secured firmly to the top surface of a movable carriage 80, as by bolts 84. Specifically, the hollow boss 82 receives a shaft 85, the upper end of which is extended into the tool holder plate 81. Said shaft has an enlarged diameter at 86 upon which is seated a pinion 87. This assembly is secured into a unitary whole, by bolts 88 which extend through the tool holder plate and pinion and threaded into shaft enlargement 86. The lower end of shaft 85 is journalled in bearings 89 carried by the bottom end of the boss whereas the upper end of said shaft is journalled in bearings 91.

The baseplate 83 has extending through it to one side of pinion 87, a passageway in which is slidably mounted a pinionengaging rack 92, one end of which is connected to the piston rod 93 of a piston-cylinder assembly 94. The piston-cylinder assembly is hydraulically actuated so as to cause the rack to oscillatably rotate pinion 87 and the tool holder plate 81. The amount of rotation of said plate is determined by a sensing valve under control of the operator.

As best shown in FIG. 1 the tool holder plate 81 carries the tool holder assembly 96 which is effective during oscillatable rotation of the tool holder plate 81 to sweep across one end of the tubular work piece W and be advanced toward the work by means of forward movement of carriage 80, for forging same. Reciprocal movement of the carriage 80 is accomplished by an hydraulic piston-cylinder assembly 97 connected thereto by a rod 98.

For use when necking, which requires that the tool holder assembly rotate a given distance that is less than the distance rotated to close a tube end, there is mounted on one end of base plate 83 a necking attachment switch assembly 99, best shown in FIGS. 6 and 7. As there illustrated, the switch assembly comprises a substantially elongated housing 100 that is secured to base plate 83 and which includes an area of increased width having a depending hollow boss 101 in which is mounted an extending cam shaft 102 having firmly secured to its lower end a switch cam 103. The switch cam 103 has a land 103*a* that is located to cooperate with a plunger 104*a* provided to operate a switch 104. The shaft extends snuggly through a tubular sleeve 105 to which is secured firmly, as by welding, a pinion 106. The shaft extends above the top face of pinion 106 and it has threaded and pinned thereon a set wheel 107. The timing and duration of contact of the land 103*a* with the plunger 104*a* is controlled by adjustment of the switch cam 103 through manual setting of the set wheel 107. After adjustment, the set wheel is secured against displacement by a set screw 108 that bears on the top face of the pinion and which serves to mechanically connect the cam assembly with the pinion.

Rotational movement of pinion 106 and switch cam 103 is effected by the flow of hydraulic pressurized fluid through a duct 109 to a cylinder 110 so as to reciprocate a piston 111 connected to rack 112 that is meshed at all times with pinion 106. Thus, it will be seen that intermittent flow of fluid to the cylinder will oscillatably rotate switch cam 103 to periodically actuate the switch so as to carry the forging tool across the work piece a pre-determined distance to produce a neck 113 thereon (FIG. 10).

The tool holder 96 is best shown in FIG. 9, where it is to be noted that it includes a base plate 114 seated firmly on and attached to the tool holder plate 81, preferably with a spacer plate 115 arranged between them. The base plate 114 preferably is in the form of a dove-tail so as to slidably receive thereon a slide plate 116 having a tool holder block 117 secured, as by welding, to its top surface. The tool 118 is secured to block 117 by a clamp 119 so as to be readily removed when required.

The slide plate 116 has on its rearmost edge a depending flange 121 which journals a threaded shaft 122 that is threaded into the base plate 114 so that upon rotation of said shaft 122 the slide plate 116 may be moved toward and away from the work piece W carried by collet 17. Inward movement of screw shaft 122 is limited by an adjustable stop 123 carried in the base plate in axial alignment with screw 122.

Remote control of rotation of threaded shaft 122 is accomplished by means of an air motor 124 mounted securely on slide plate 116 and having its shaft 125 projecting downwardly into a lubricant containing cylinder 126 within which is a worm 127 on shaft 125, that meshes at all times with a gear 128 carried firmly on screw shaft 122. Thus, when motor 124 is operated in either direction, the tool 118 is advanced toward or withdrawn away from the work piece W and, when carried into contact with the work piece, the turntable 81 is oscillatably rotated upon selective delivery of hydraulic fluid to either end of piston-cylinder assembly 94 (FIG. 6). The amount of oscillatable rotation is controlled by the setting of cam switch 99.

OPERATION

Figure 13:
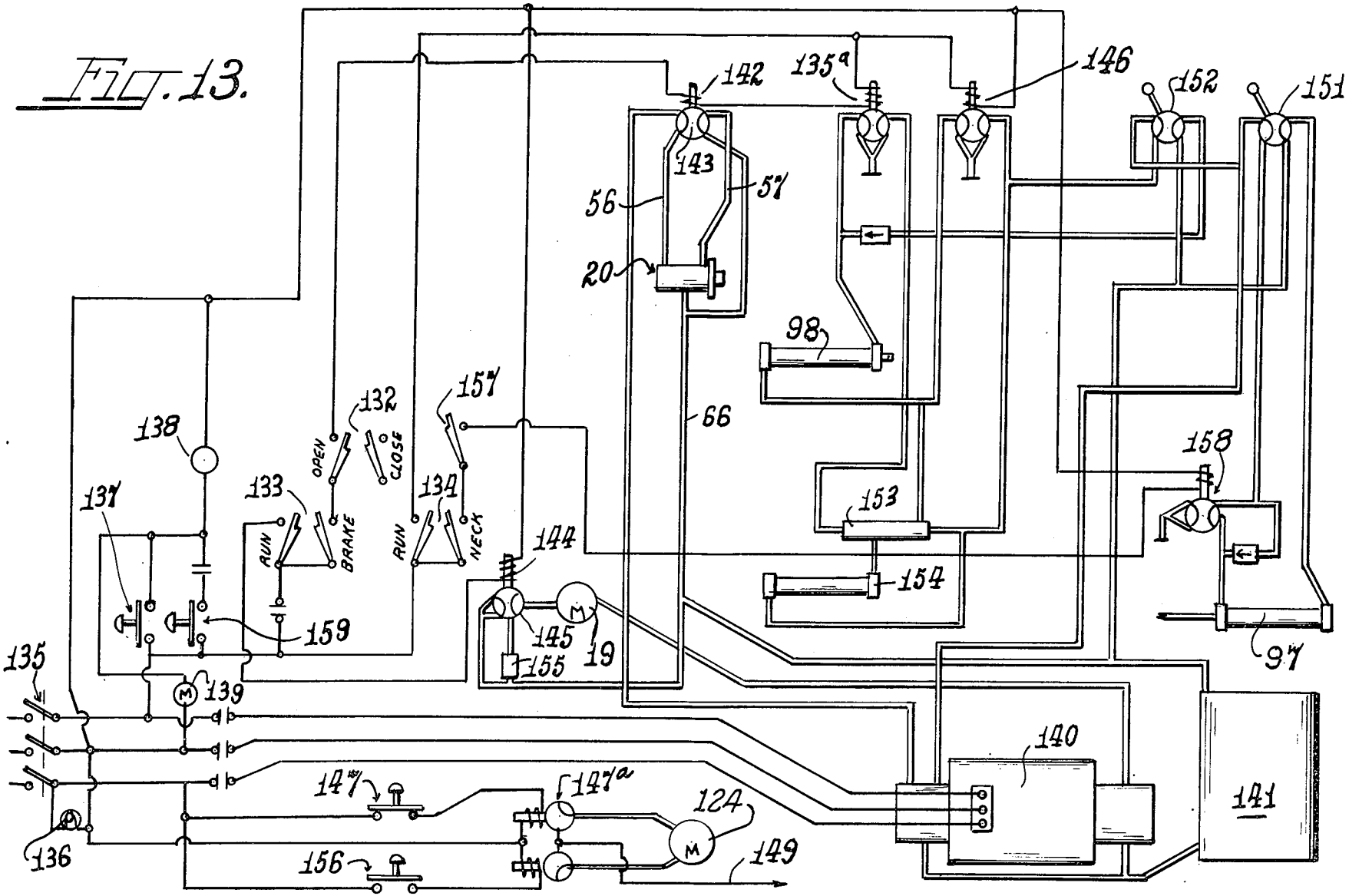
FIG. 13 is a schematic of the hydraulic and electrical circuits embodied in the machine.

Total operation of the spin lathe can best be described upon reference to the schematic of the electric and hydraulic circuitry illustrated in FIG. 13.

To set up the spin lathe for operation, switch 132 is moved to "open" position; switch 133 is positioned in "brake" position and switch 134 is positioned in (a neutral) position. The main line switch 135 is now closed, illuminating warning light 136.

Switch 137 is manually closed to operate relay 138 and motor 139. With motor 139 operating, the hydraulic pump unit 140, connected to hydraulic fluid tank 141 is started up and the lathe is now operational.

One end of a work piece W is heated and it is thrust into the lathe collet 17 with the heated end extending out beyond the collet. Switch 132 is moved to "closed" position so as to energize solenoid 142 which is operational to position hydraulic valve 143 to deliver pressurized fluid to the rotary flow element 20, and close the collet jaws about the work piece. Switch 133 is now moved into "run" position. This energizes solenoid 144 controlling valve 145 thus admitting pressurized fluid to drive motor 19 for rotating spindle 16 and the workpiece mounted therein.

Switch 134 is moved into "run" position so as to energize solenoid valves 135*a* and 146, opening same to deliver fluid to carriage cylinder 98, a shunt valve 153 and an increment valve 154. The carriage 80 and the tool holder assembly 15 can now be advanced to carry the tool into contact with the work-piece by closing solenoid switch 147, which opens valve 147*a* to operate the air motor 124, which has a connection with an air line 149 leading from a source of pressurized air.

The tool holder 15 can now be swept back and forth across the hot end of the work piece to forge and close said end upon sequential operation of the hand valves 151 and 152, which also function to admit fluid to one end of the carriage cylinder 98 to advance the tool holder carriage 80 forwardly toward the work piece.

Forward movement of carriage 80 is automatically controlled to a pre-set limit of advance by means of the shunt valve 153 and the increment valve 154. When the work piece end is closed to an amount determined by precedent and experience, the operator will "blow" the center of the work piece with oxygen by means of lance L, to clean scale and slag from the center of the end being closed. Thereafter, the center is immediately closed by further machine operation until the required amount of metal is turned in for forming an end thickness as demanded by the use to which the finished vessel is to be put.

The lathe is now stopped by moving switch 133 to brake position. This causes solenoid valve 145 to block the flow of hydraulic fluid from drive motor 19 and force it through pressure regulator valve 155 thereby effectively braking the lathe to a complete stop. The collet is then opened by moving switch 132 to open position thus actuating valve 143 to reverse the flow of fluid to rotary element 20. The tool holder is then backed off from the work piece by closing switch 156 to reverse the flow of air to air motor 124. The work piece can now be pulled out of the collet. The finished end of the work piece will now appear as shown at X in FIG. 10 and if desired, it may be formed in a press substantially flat as indicated in dotted lines at said end.

With the switch 134 in run position, the carriage can be backed off rapidly upon operation of hand valve 151. Returning switch 134 to its center position will return the increment circuit to operation for performance of the next step of the operation.

The other end of the work piece W is now heated and it is chucked into the collet of the spin lathe with said hot end extending out into position to be necked by the tool. Spinning of the work piece is now effected as before, and the work holder carriage 81 is incrementally advanced toward the work piece while the tool 118 sweeps across the hot end thereof until precedence and experience indicates that necking should begin. To accomplish this, the switch 134 is moved into neck position. Turntable 15 and tool holder 96 mounted thereon will now oscilate to such point across the end of the work piece a suitable number of passes, each as determined by dial 107 of the hydraulic necking attachment 99 (FIG. 6–7). At such point of time, switch 157 is operated to close solenoid valve 158 and block the flow of hydraulic fluid from turntable cylinder 97 thus stopping turntable and tool operation and further formation of the neck 13 shown at end Y in FIG. 10.

Switch 133 is now returned to brake position, stopping the lathe. The tool holder 96 is backed away from the work piece upon closing switch 156 to operate air motor 124 in a reverse direction. Opening switch 159 closes down all functions of the spin lathe, applies the brakes, and holds the collet in closed position. The same close down will occur should there be a power failure thus preventing the collet from opening and ejecting the work piece while the spindle is still rotating. After the lathe has come to a stop, the collet jaws are opened as before and the finished work piece is removed from the collet.

Although I have described a preferred embodiment of the invention, in considerable detail, it will be understood that the description thereof is intended to be illustrative, rather than restrictive, as details of the structure and method may be modified or changed without departing from the spirit or scope of the invention. Accordingly, I do not desire to be restricted to the exact construction described and shown.

I claim:

1. In a spin lathe having a rotary spindle and a collet at one end thereof, an axially reciprocable cylindrical element in and rotatable with said spindle operably connected at one end to the collet for causing opening and closing of same upon axial reciprocation of said element, a piston on the other end of said element, and a housing rotatable with the spindle defining a chamber in which said piston operates, said housing having an end wall, the improvement comprising; an hydraulic element through which pressurized fluid is selectively delivered to opposite faces of the piston, said hydraulic element comprising a non-rotatable body, a hollow core in said body connected to said end wall for rotation therewith, an oil tube in said hollow core rotatable therewith and defining a fluid passageway between the tube and core, means to convey pressurized fluid to the fluid passageway for delivery to one face of the piston, and means to convey pressurized fluid to the tube interior for delivery of fluid to the other face of said piston.

2. The spin lathe recited in claim 1, wherein the means to convey pressurized fluid to the passageway and to the tube interior includes manually actuable valves.

3. The spin lathe recited in claim 1, wherein the hollow core has radial ports flow-connecting the passageway with the fluid inlet means.

4. The spin lathe recited in claim 1, wherein the hollow core has radial ports flow-connecting the tube interior with fluid inlet means.

5. The spin lathe recited in claim 1, wherein the hollow core has radial ports and the body has circumferential channels on its inside surface providing flow conduits to the radial ports.

6. The spin lathe recited in claim 1, wherein means is provided in the body to drain fluid leakage therefrom.

7. The spin lathe recited in claim 1, wherein a thrust plate secures the hollow core to the body.

8. The spin lathe recited in claim 1, wherein the sleeve is press fitted into the hollow core.

9. The spin lathe recited in claim 1, wherein the sleeve is of reduced diameter for a part of its length to provide the fluid passageway.

10. The spin lathe recited in claim 1, wherein a rotatable tool holder is located adjacent to but spaced from the collet.

11. The spin lathe recited in claim 1, wherein automatic means is provided to limit rotation of the tool holder.

12. The spin lathe recited in claim 1, wherein a work piece is held in said collet and a hydraulically actuated turntable tool is movable toward the workpiece by a variable definitely regulated increment.

13. In a spin lathe having a rotary work holding spindle and a forging tool associated therewith, electrically controlled hydraulic means operable to cause the forging tool to repeatedly sweep across the work piece, an electric circuit for said control means, an on-off switch in said circuit effective to control the length of the sweep of said forging tool, an operating plunger in said switch, an hydraulically actuated oscillatably rotatable cam operable to actuate said plunger, and manual means to re-set the cam.

14. In a spin lathe having a rotary work holding spindle and a forging tool associated therewith, electrically controlled hydraulic means operable to cause the forging tool to repeatedly sweep across the work piece, an electric circuit for said control means, an hydraulically controlled on-off switch in said circuit effective to control the length of the sweep of said forging tool, and a manually adjustable cam for actuating said switch.

15. The spin lathe recited in claim 14, wherein rack actuated means is provided to actuate the switch actuating cam.

16. The spin lathe recited in claim 14, wherein the control switch includes means to adjust the switch actuating cam relative to the switch to vary the length of sweep of said forging tool.

* * * * *